US011113917B2

(12) United States Patent
Chen

(10) Patent No.: US 11,113,917 B2
(45) Date of Patent: Sep. 7, 2021

(54) METHOD FOR IMPLEMENTING BANKNOTE COUNTING OF BANKNOTE COUNTING DEVICE, AND BANKNOTE COUNTING DEVICE

(71) Applicant: Comix Business Machine(Shenzhen)Co., Ltd., Shenzhen (CN)

(72) Inventor: Qinpeng Chen, Shenzhen (CN)

(73) Assignee: Comix Business Machine(Shenzhen)Co., Ltd., Shenzhen (CN)

( * ) Notice: Subject to any disclaimer, the term of this patent is extended or adjusted under 35 U.S.C. 154(b) by 0 days.

(21) Appl. No.: 16/757,745

(22) PCT Filed: Nov. 27, 2017

(86) PCT No.: PCT/CN2017/113135
§ 371 (c)(1),
(2) Date: Apr. 20, 2020

(87) PCT Pub. No.: WO2019/100390
PCT Pub. Date: May 31, 2019

(65) Prior Publication Data
US 2021/0192878 A1 Jun. 24, 2021

(51) Int. Cl.
*G07D 7/00* (2016.01)
*G06M 7/06* (2006.01)

(52) U.S. Cl.
CPC ..... *G07D 7/00* (2013.01); *G06M 7/06* (2013.01)

(58) Field of Classification Search
CPC ..... G07D 7/00; G06M 7/06
(Continued)

(56) References Cited

U.S. PATENT DOCUMENTS 6,065,672 A * 5/2000 Haycock ..... G07D 11/34 235/379
6,131,718 A 10/2000 Witschorik
(Continued)

FOREIGN PATENT DOCUMENTS

CN 101976475 A 2/2011
CN 102034203 A 4/2011
(Continued)

OTHER PUBLICATIONS

International Search Report of PCT/CN2017/113135.
Written Opinion of PCT/CN2017/113135.

*Primary Examiner* — Daniel A Hess
(74) *Attorney, Agent, or Firm* — Dragon Sun Law Firm, PC; Jinggao Li, Esq.

(57) ABSTRACT

A method for implementing banknote counting includes: if counterfeit banknote is detected in the banknote counting process, recording the sequence, the denomination, and the quantity of the counterfeit banknote; extracting the counterfeit banknote and calculating the amount of the counterfeit banknote; determining, according to a user identity information, whether a circulation amount of counterfeit currency and number of times of circulation of counterfeit currency having a mapping relationship to the user identity information exist in a preset counterfeit currency circulation database; if existing, updating the circulation amount of counterfeit currency and changing the number of times of circulation of counterfeit currency; and if the updated circulation amount of counterfeit currency is greater than a preset amount threshold and the updated number of times of circulation of counterfeit currency is greater than a preset number of circulation threshold, sending an investigation instruction to the public security department.

16 Claims, 4 Drawing Sheets

(58) Field of Classification Search
USPC ..... 235/379
See application file for complete search history.

(56) References Cited

U.S. PATENT DOCUMENTS 6,615,193 B1 * 9/2003 Kingdon ..... G06Q 20/06 235/379
8,181,856 B1 * 5/2012 Folk ..... G06Q 30/06 235/379
8,201,680 B1 * 6/2012 Folk ..... G07D 11/14 194/206
8,756,158 B2 * 6/2014 Colvin ..... G07D 11/36 705/43
2006/0151595 A1 * 7/2006 Carpenter ..... G07F 19/20 235/379
2007/0095897 A1 * 5/2007 Carpenter ..... G07F 19/206 235/379
2007/0187485 A1 * 8/2007 Aas ..... G07D 11/135 235/379
2008/0106726 A1 5/2008 Ellis
2010/0025183 A1 * 2/2010 Folk ..... G07D 11/25 194/200
2010/0198396 A1 * 8/2010 Brexel ..... G07D 11/25 700/219
2011/0258090 A1 * 10/2011 Bosch ..... G06Q 40/02 705/30
2013/0232064 A1 * 9/2013 Bosch ..... G07F 19/20 705/43
2015/0170266 A1 * 6/2015 Monkiewicz ..... G06Q 40/02 235/379

FOREIGN PATENT DOCUMENTS

CN 102289894 A 12/2011
CN 105144252 A 12/2015
CN 107305560 A 10/2017

* cited by examiner

METHOD FOR IMPLEMENTING BANKNOTE COUNTING OF BANKNOTE COUNTING DEVICE, AND BANKNOTE COUNTING DEVICE

This application is a national stage application of PCT Application No. PCT/CN2017/113135. This application claims priority from PCT Application No. PCT/CN2017/113135, filed Nov. 27, 2017, the content of which is incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present disclosure relates to the field of electronic devices, and more particularly to a method for implementing banknote counting of banknote counting device and a banknote counting device.

BACKGROUND

With the continuous development of bank's financial and cash business, a large amount of cash needs to be counted by banknote counting devices. Further, in order to record the handling of customer's cash, bank staff needs to report the counting results after the banknote counting is completed.

At present, financial special banknote counting device in the bank can only achieve the function of banknotes counting, and the amount of the counted banknotes still needs to be manually calculated by the bank staff. In addition, the banknote counting device does not have the function of removing counterfeit currency.

Therefore, a heretofore unaddressed need exists in the art to address the aforementioned deficiencies and inadequacies.

SUMMARY

Technical Problem

The present disclosure is to solve the technical problem that the banknote counting device in the prior art can only achieve the function of banknotes counting, the amount of the counted banknotes still needs to be manually calculated by the bank staff, and the banknote counting device does not have the function of removing counterfeit currency.

Technical Solution

In order to achieve the above aim, the present disclosure provides a method for implementing banknote counting of a banknote counting device. The method for implementing banknote counting includes:

turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote;

extracting the counterfeit banknote from the banknotes that have been counted according to the sequence of the counterfeit banknote, and calculating the amount of the counterfeit banknote based on the quantity of the counterfeit banknote and the denomination of each counterfeit banknote;

acquiring the user identity information in the banknote counting instruction, and determining, according to the user identity information, whether a circulation amount and number of times of circulation of counterfeit currency having a mapping relationship to the user identity information exist in a preset counterfeit currency circulation database;

if existing, calculating the sum of the circulation amount of counterfeit currency and the amount of the counterfeit banknote, and updating the circulation amount of counterfeit currency according to the sum; and adding "1" to the number of times of circulation of counterfeit currency and updating the number of times of circulation of counterfeit currency according to the calculation result; and if the updated circulation amount of counterfeit currency is greater than a preset amount threshold and the updated number of times of circulation of counterfeit currency is greater than a preset number of times of circulation threshold, sending an investigation instruction to the public security department according to the user identity information, the updated circulation amount of counterfeit currency, and the number of times of circulation of counterfeit currency, to allow the public security department implementing the investigation instruction in time.

Preferably, after the operation of acquiring the user identity information in the banknote counting instruction, and determining, according to the user identity information, whether the circulation amount and number of times of circulation of counterfeit currency having a mapping relationship to the user identity information exist in a preset counterfeit currency circulation database, the method for implementing banknote counting further includes:

establishing a mapping relationship among the user identity information, the amount of the counterfeit banknote calculated, and the number of times of circulation of counterfeit currency in the counterfeit currency circulation database, if the circulation amount of counterfeit currency and the number of times of circulation of counterfeit currency having a mapping relationship to the user identity information does not exist in the counterfeit currency circulation database, where the number of times of circulation of counterfeit currency is recorded as "1".

Preferably, after the operation of extracting the counterfeit banknote from the banknotes that have been counted according to the sequence of the counterfeit banknote, and calculating the amount of the counterfeit banknote based on the quantity of the counterfeit banknote and the denomination of each counterfeit banknote, the method for implementing banknote counting further includes:

displaying the quantity of the counterfeit banknote and the amount of the counterfeit banknote.

Preferably, after the operation of turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote, the banknote counting method further includes:

recording the quantity of genuine banknote and the denomination of each genuine banknote, and calculating the amount of the genuine banknote based on the quantity of genuine banknote and the denomination of each genuine banknote.

Preferably, after the operation of recording the quantity of genuine banknote and the denomination of each genuine banknote, and calculating the amount of the genuine banknote based on the quantity of genuine banknote and the denomination of each genuine banknote, the method for implementing banknote counting further includes:

displaying the quantity of the genuine banknote and the amount of the genuine banknote.

In addition, in order to achieve the above aim, the present disclosure further provides a banknote counting device, which includes:

a recording module, configured for turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote;

an extracting module, configured for extracting the counterfeit banknote from the banknotes that have been counted according to the sequence of the counterfeit banknote, and calculating the amount of the counterfeit banknote based on the quantity of the counterfeit banknote and the denomination of each counterfeit banknote;

a determining module, configured for acquiring the user identity information in the banknote counting instruction, and determining, according to the user identity information, whether a circulation amount and number of times of circulation of counterfeit currency having a mapping relationship to the user identity information exist in a preset counterfeit currency circulation database;

a calculating module, configured for, if the circulation amount and number of times of circulation of counterfeit currency having a mapping relationship to the user identity information exist in the preset counterfeit currency circulation database, calculating the sum of the circulation amount of counterfeit currency and the amount of the counterfeit banknote, and updating the circulation amount of counterfeit currency according to the sum; and adding "1" to the number of times of circulation of counterfeit currency and updating the number of times of circulation of counterfeit currency according to the calculation result; and an alarming module, configured for, if the updated circulation amount of counterfeit currency is greater than a preset amount threshold and the updated number of times of circulation of counterfeit currency is greater than a preset number of times of circulation threshold, sending an investigation instruction to the public security department according to the user identity information, the updated circulation amount of counterfeit currency, and the number of times of circulation of counterfeit currency, to allow the public security department implementing the investigation instruction in time.

Preferably, the banknote counting device further includes:

an establishing module, configured for establishing a mapping relationship among the user identity information, the amount of the counterfeit banknote calculated, and the number of times of circulation of counterfeit currency in the counterfeit currency circulation database, if the circulation amount of counterfeit currency and the number of times of circulation of counterfeit currency having a mapping relationship to the user identity information does not exist in the counterfeit currency circulation database, where the number of times of circulation of counterfeit currency is recorded as "1".

Preferably, the banknote counting device further includes:

a displaying module, configured for displaying the quantity of the counterfeit banknote and the amount of the counterfeit banknote.

Preferably, the calculating module is further configured for recording the quantity of genuine banknote and the denomination of each genuine banknote, and calculating the amount of the genuine banknote based on the quantity of genuine banknote and the denomination of each genuine banknote.

Preferably, the displaying module is further configured for displaying the quantity of the genuine banknote and the amount of the genuine banknote.

The method for implementing banknote counting and the banknote counting device provided by the present disclosure can automatically calculate the amount of counted banknotes, and can find out and pick out counterfeit banknote from numerous banknotes, which greatly reduces the workload of the staff, and moreover, can provide investigation data to the cases of counterfeit currency circulation to achieve the purpose of cracking down on illegal and criminal activities involving counterfeit currency.

BRIEF DESCRIPTION OF THE DRAWINGS

The accompanying drawings illustrate one or more embodiments of the present disclosure and, together with the written description, serve to explain the principles of the invention. Wherever possible, the same reference numbers are used throughout the drawings to refer to the same or like elements of an embodiment.

Figure 1:
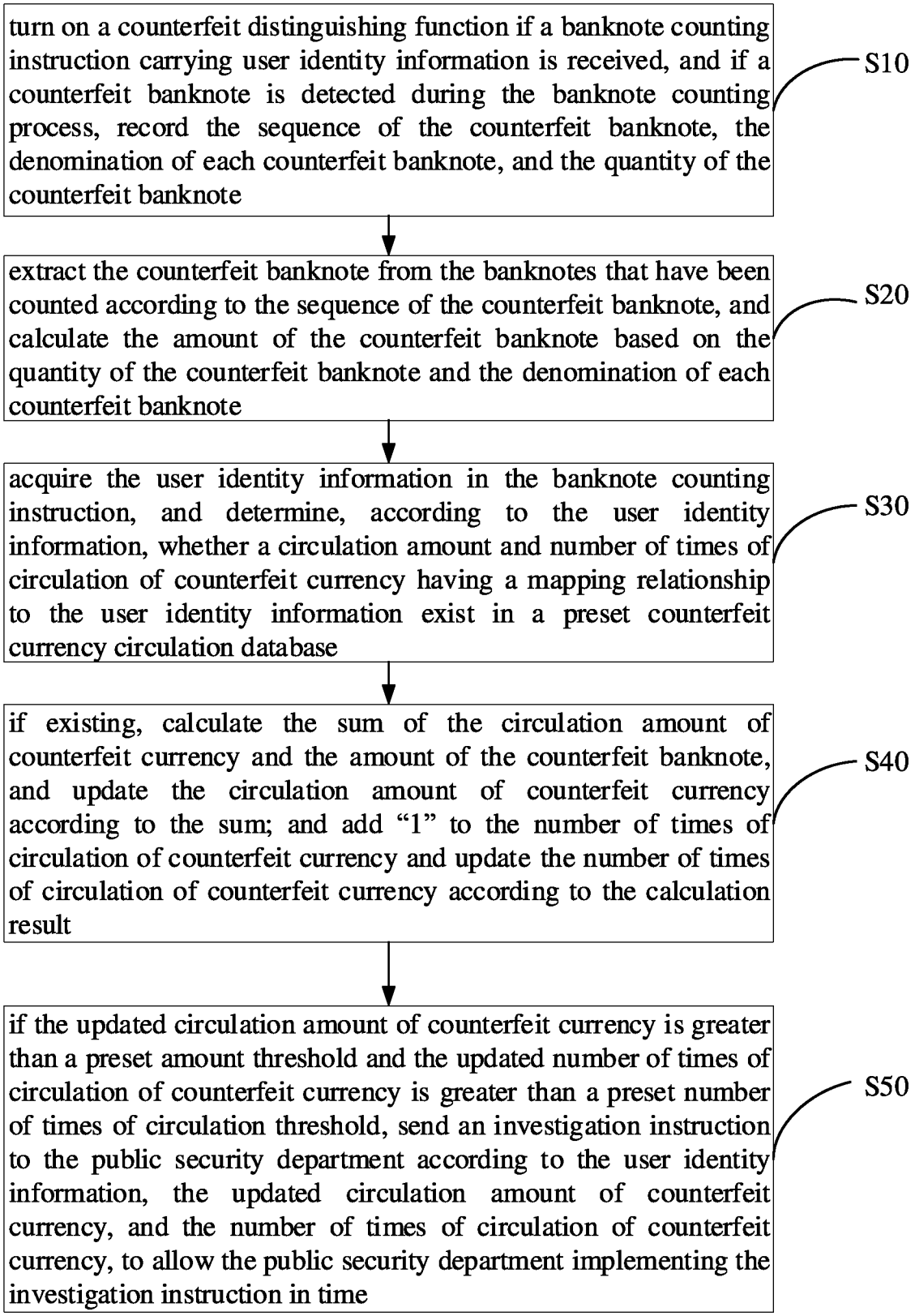
FIG. 1 is a flowchart of a method for implementing banknote counting in accordance with an embodiment of the present disclosure.

The realization of the purpose, the features, and the advantages of the present disclosure will be further described with reference to the accompanying drawings.

DETAILED DESCRIPTION OF THE EMBODIMENTS

The present disclosure will now be described more fully hereinafter with reference to the accompanying drawings, in which exemplary embodiments of the present disclosure are shown. The present disclosure may, however, be embodied in many different forms and should not be construed as limited to the embodiments set forth herein. Rather, these embodiments are provided so that this disclosure is thorough and complete, and will fully convey the scope of the invention to those skilled in the art. Like reference numerals refer to like elements throughout.

The technical solutions of the embodiments of the present disclosure will be described in the following with reference to the accompanying drawings. It should be understood that the preferred embodiments described herein are only used to illustrate and explain the present disclosure, and are not to limit the present disclosure. In the case of no conflict, the embodiments and features in the embodiments can be combined with each other.

The present disclosure provides a method for implementing banknote counting. Please referring to FIG. 1, which is a flowchart of the method for implementing banknote counting in accordance with an embodiment of the present disclosure. In the exemplary embodiment, the method for implementing banknote counting includes:

Step S10, a counterfeit distinguishing function is turned on if a banknote counting instruction carrying user identity information is received, and if counterfeit banknote is detected during the banknote counting process, the sequence of the counterfeit banknote, the denomination of each counterfeit banknote, and the quantity of the counterfeit banknote are recorded.

Step 20, the counterfeit banknote is extracted from the banknotes that have been counted according to the sequence of the counterfeit banknote, and the amount of the counterfeit banknote is calculated based on the quantity of the counterfeit banknote and the denomination of each counterfeit banknote.

In the exemplary embodiment, the operation of extracting the counterfeit banknote from the banknotes that have been counted according to the sequence of the counterfeit banknote is specifically carried out as follows: the banknotes that have been counted are sent into the banknote counting entrance to be counted for a second time, and when the banknote in the sequence is counted, the banknote is extracted and sent to a preset counterfeit banknote storing region.

Step 30, the user identity information in the banknote counting instruction is acquired, and whether a circulation amount and number of times of circulation of counterfeit currency having a mapping relationship to the user identity information exist in a preset counterfeit currency circulation database is determined according to the user identity information.

The user identity information in the exemplary embodiment includes but not limited to, a user name, an ID number, and a mobile phone number.

The counterfeit currency circulation database described in the exemplary embodiment may be a counterfeit currency circulation database maintained by the bank's own system or a counterfeit currency circulation database maintained by the national system.

Step 40, if the circulation amount and number of times of circulation of counterfeit currency having a mapping relationship to the user identity information exist in the preset counterfeit currency circulation database, the sum of the circulation amount of counterfeit currency and the amount of the counterfeit banknote is calculated, and the circulation amount of counterfeit currency is updated according to the sum; and the number of times of circulation of counterfeit currency is added with "1", and the number of times of circulation of counterfeit currency is updated according to the calculation result.

Step 50, if the updated circulation amount of counterfeit currency is greater than a preset amount threshold and the updated number of times of circulation of counterfeit currency is greater than a preset number of times of circulation threshold, an investigation instruction is sent to the public security department according to the user identity information, the updated circulation amount of counterfeit currency, and the number of times of circulation of counterfeit currency, to allow the public security department implementing the investigation instruction in time.

Further, in the exemplary embodiment, after the operation of acquiring the user identity information in the banknote counting instruction, and determining, according to the user identity information, whether the circulation amount and number of times of circulation of counterfeit currency having a mapping relationship to the user identity information exist in a preset counterfeit currency circulation database, the method for implementing banknote counting further includes: establishing a mapping relationship among the user identity information, the amount of the counterfeit banknote calculated, and the number of times of circulation of counterfeit currency in the counterfeit currency circulation database, if the circulation amount of counterfeit currency and the number of times of circulation of counterfeit currency having a mapping relationship to the user identity information does not exist in the counterfeit currency circulation database, where the number of times of circulation of counterfeit currency is recorded as "1".

Further, in the exemplary embodiment, after the operation of extracting the counterfeit banknote from the banknotes that have been counted according to the sequence of the counterfeit banknote, and calculating the amount of the counterfeit banknote based on the quantity of the counterfeit banknote and the denomination of each counterfeit banknote, the method for implementing banknote counting further includes: displaying the quantity of the counterfeit banknote and the amount of the counterfeit banknote.

Further, in the exemplary embodiment, after the operation of turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote, the banknote counting method further includes: recording the quantity of genuine banknote and the denomination of each genuine banknote, and calculating the amount of the genuine banknote based on the quantity of genuine banknote and the denomination of each genuine banknote.

Further, in the exemplary embodiment, after the operation of recording the quantity of genuine banknote and the denomination of each genuine banknote, and calculating the amount of the genuine banknote based on the quantity of genuine banknote and the denomination of each genuine banknote, the method for implementing banknote counting further includes: displaying the quantity of the genuine banknote and the amount of the genuine banknote.

The method for implementing banknote counting provided by the present disclosure can automatically calculate the amount of counted banknotes, and can find out and pick out counterfeit banknote from numerous banknotes, which greatly reduces the workload of the staff, and moreover, can provide investigation data to the cases of counterfeit currency circulation to achieve the purpose of cracking down on illegal and criminal activities involving counterfeit currency.

Figure 2:
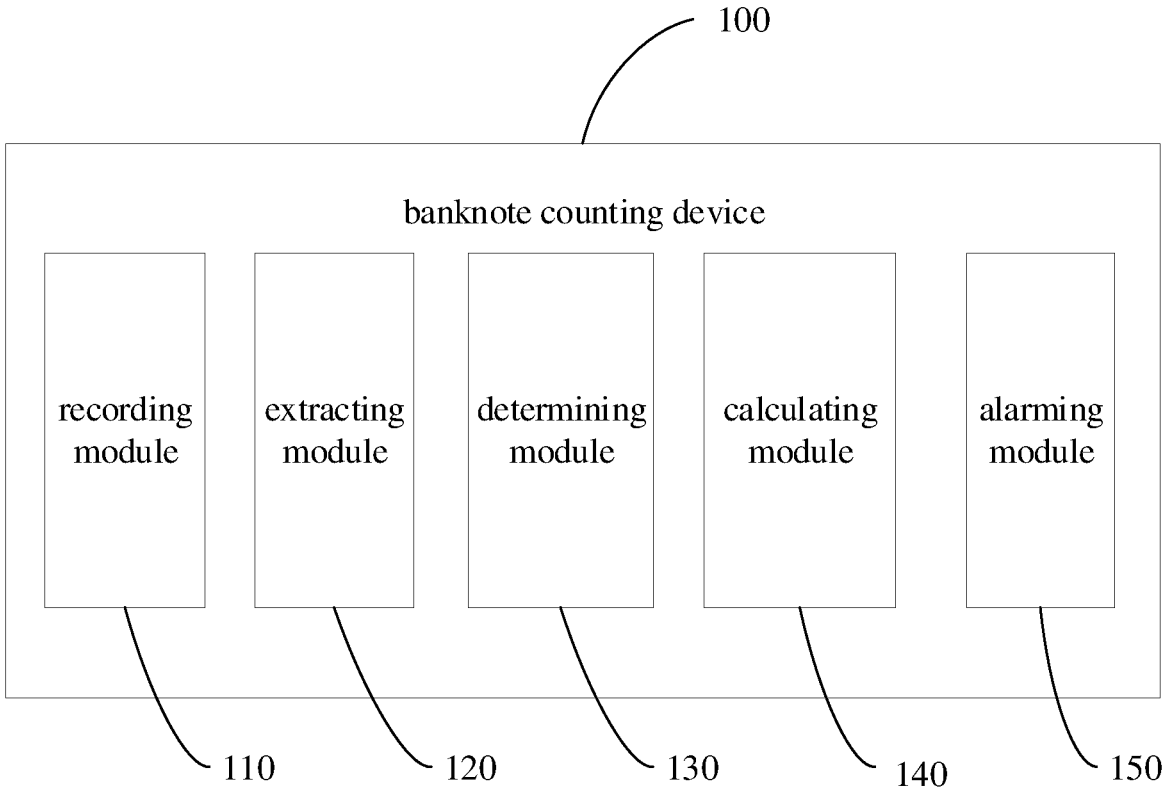
FIG. 2 is a schematic view of function modules of a banknote counting device in accordance with an embodiment of the present disclosure.

The present disclosure provides a banknote counting device. Please referring to FIG. 2, which is a schematic view of function modules of the banknote counting device in accordance with an embodiment of the present disclosure. In the exemplary embodiment, the banknote counting device 100 includes a recording module 110, an extracting module 120, a determining module 130, a calculating module 140, and an alarming module 150. The recording module 110 is configured for turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote. The extracting module 120 is configured for extracting the counterfeit banknote from the banknotes that have been counted according to the sequence of the counterfeit banknote, and calculating the amount of the counterfeit banknote based on the quantity of the counterfeit banknote and the denomination of each counterfeit banknote. The determining module 130 is configured for acquiring the user identity information in the banknote counting instruction, and determining, according to the user identity information, whether a circulation amount and number of times of circulation of counterfeit currency having a mapping relationship to the user identity information exist in a preset counterfeit currency circulation database. The calculating module 140 is configured for, if the circulation amount and number of times of circulation of counterfeit currency having a mapping relationship to the user identity information exist in the preset counterfeit currency circulation database, calculating the sum of the circulation amount of counterfeit currency and the amount of the counterfeit banknote, and updating the circulation amount of counterfeit currency according to the sum; and adding "1" to the number of times of circulation of counterfeit currency and updating the number of times of circulation of counterfeit currency according to the calculation result. The alarming module 150 is configured for, if the updated circulation amount of counterfeit currency is greater than a preset amount threshold and the updated number of times of circulation of counterfeit currency is greater than a preset number of times of circulation threshold, sending an investigation instruction to the public security department according to the user identity information, the updated circulation amount of counterfeit currency, and the number of times of circulation of counterfeit currency, to allow the public security department implementing the investigation instruction in time.

In the exemplary embodiment, the extracting module 120 extracting the counterfeit banknote from the banknotes that have been counted according to the sequence of the counterfeit banknote is specifically carried out as follows: the banknotes that have been counted are sent into the banknote counting entrance to be counted for a second time, and when the banknote in the sequence is counted, the banknote is extracted and sent to a preset counterfeit banknote storing region.

The user identity information in the exemplary embodiment includes but not limited to, a user name, an ID number, and a mobile phone number.

The counterfeit currency circulation database described in the exemplary embodiment may be a counterfeit currency circulation database maintained by the bank's own system or a counterfeit currency circulation database maintained by the national system.

Figure 3:
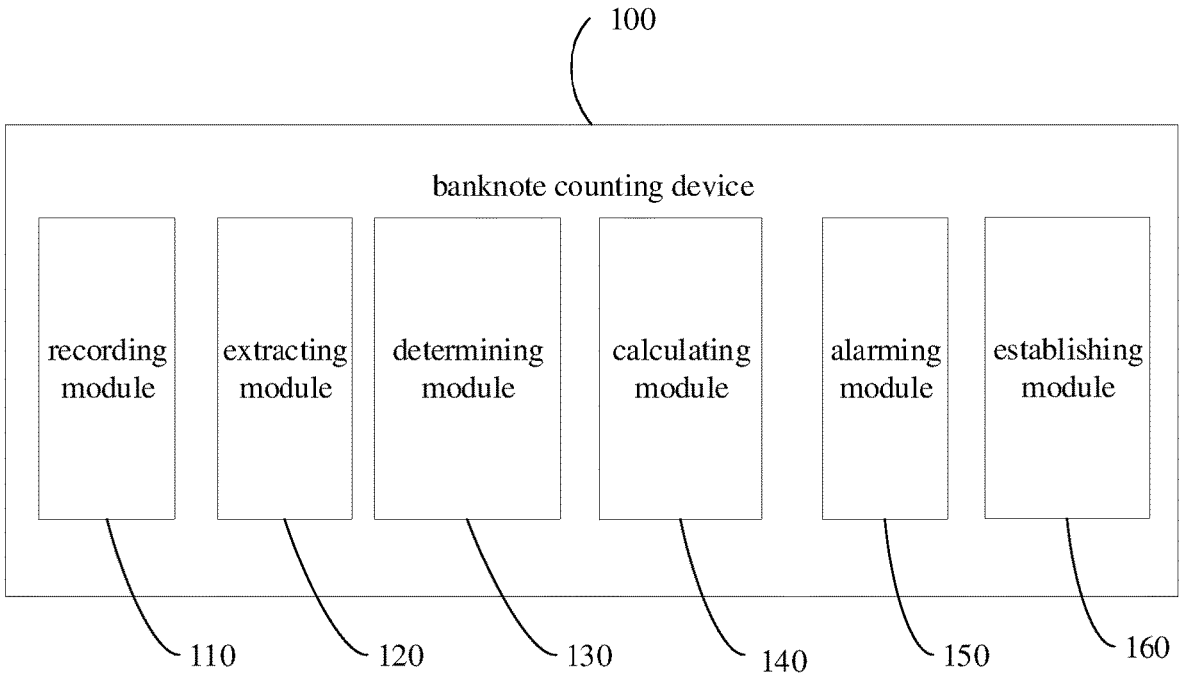
FIG. 3 is a schematic view of function modules of the banknote counting device in accordance with another embodiment of the present disclosure.

Referring to FIG. 3, which is a schematic view of function modules of the banknote counting device in accordance with another embodiment of the present disclosure. In the exemplary embodiment, the banknote counting device 100 further includes an establishing module 160. The establishing module 160 is configured for establishing a mapping relationship among the user identity information, the amount of the counterfeit banknote calculated, and the number of times of circulation of counterfeit currency in the counterfeit currency circulation database, if the circulation amount of counterfeit currency and the number of times of circulation of counterfeit currency having a mapping relationship to the user identity information does not exist in the counterfeit currency circulation database, where the number of times of circulation of counterfeit currency is recorded as "1".

Figure 4:
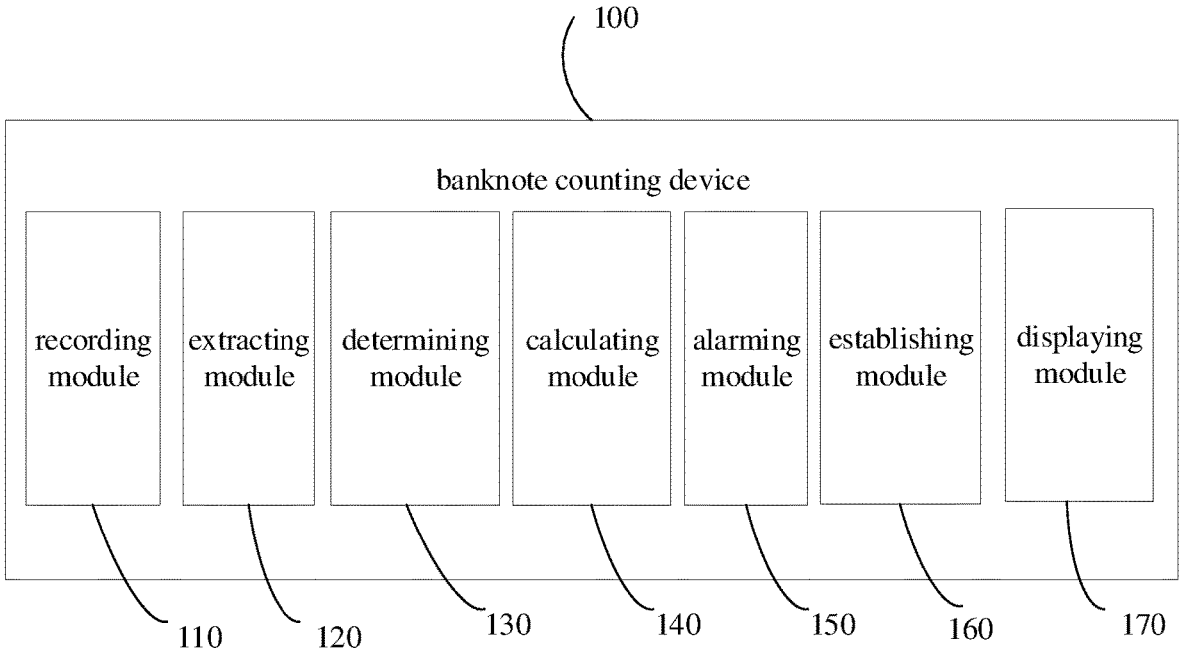
FIG. 4 is a schematic view of function modules of the banknote counting device in accordance with a further embodiment of the present disclosure.

Referring to FIG. 4, which is a schematic view of function modules of the banknote counting device according to a further embodiment. In the exemplary embodiment, the banknote counting device 100 further includes a displaying module 170. The displaying module 170 is configured for displaying the quantity of the counterfeit banknote and the amount of the counterfeit banknote.

Further, the calculating module 140 described in the embodiments above is further configured for recording the quantity of genuine banknote and the denomination of each genuine banknote, and calculating the amount of the genuine banknote based on the quantity of genuine banknote and the denomination of each genuine banknote.

Further, the displaying module 170 described in the embodiments above is further configured for displaying the quantity of the genuine banknote and the amount of the genuine banknote.

The banknote counting device provided by the present disclosure can automatically calculate the amount of counted banknotes, and can find out and pick out counterfeit banknote from numerous banknotes, which greatly reduces the workload of the staff, and moreover, can provide investigation data to the cases of counterfeit currency circulation to achieve the purpose of cracking down on illegal and criminal activities involving counterfeit currency.

What has been described above are only preferred embodiments of the present disclosure, and are not considering to limit the protection scope of the present disclosure. And any equivalent changes made in structures or process with regard to the description and drawings of the present disclosure, directly or indirectly used in other related technical fields, are all included in the protection scope of the present disclosure. The foregoing description of the exemplary embodiments of the present disclosure has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A method for implementing banknote counting of a banknote counting device, comprising:

turning on counterfeit distinguishing function if a banknote counting instruction carrying user identity information is received, and if a counterfeit banknote is detected during the banknote counting process, recording the sequence of the counterfeit banknote, the denomination of each counterfeit banknote, and the quantity of the counterfeit banknote;

extracting the counterfeit banknote from the banknotes that have been counted according to the sequence of the counterfeit banknote, and calculating the amount of the counterfeit banknote based on the quantity of the counterfeit banknote and the denomination of each counterfeit banknote;

acquiring the user identity information in the banknote counting instruction, and determining, according to the user identity information, whether a circulation amount and number of times of circulation of counterfeit currency having a mapping relationship to the user identity information exist in a preset counterfeit currency circulation database;

if existing, calculating the sum of the circulation amount of counterfeit currency and the amount of the counterfeit banknote, and updating the circulation amount of counterfeit currency according to the sum; and adding "1" to the number of times of circulation of counterfeit currency and updating the number of times of circulation of counterfeit currency according to the calculation result; and if the updated circulation amount of counterfeit currency is greater than a preset amount threshold and the updated number of times of circulation of counterfeit currency is greater than a preset number of times of circulation threshold, sending an investigation instruction to the public security department according to the user identity information, the updated circulation amount of counterfeit currency, and the number of times of circulation of counterfeit currency, to allow the public security department implementing the investigation instruction in time.

2. The method for implementing banknote counting according to claim 1, wherein after the operation of acquiring the user identity information in the banknote counting instruction, and determining, according to the user identity information, whether the circulation amount and number of times of circulation of counterfeit currency having a mapping relationship to the user identity information exist in a preset counterfeit currency circulation database, the method for implementing banknote counting further comprises:

establishing a mapping relationship among the user identity information, the amount of the counterfeit banknote calculated, and the number of times of circulation of counterfeit currency in the counterfeit currency circulation database, if the circulation amount of counterfeit currency and the number of times of circulation of counterfeit currency having a mapping relationship to the user identity information does not exist in the counterfeit currency circulation database, where the number of times of circulation of counterfeit currency is recorded as "1".

3. The method for implementing banknote counting according to claim 2, wherein after the operation of extracting the counterfeit banknote from the banknotes that have been counted according to the sequence of the counterfeit banknote, and calculating the amount of the counterfeit banknote based on the quantity of the counterfeit banknote and the denomination of each counterfeit banknote, the method for implementing banknote counting further comprises:

displaying the quantity of the counterfeit banknote and the amount of the counterfeit banknote.

4. The method for implementing banknote counting according to claim 3, wherein after the operation of turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote, the method for implementing banknote counting further comprises:

recording the quantity of genuine banknote and the denomination of each genuine banknote, and calculating the amount of the genuine banknote based on the quantity of genuine banknote and the denomination of each genuine banknote.

5. The method for implementing banknote counting according to claim 4, wherein after the operation of recording the quantity of genuine banknote and the denomination of each genuine banknote, and calculating the amount of the genuine banknote based on the quantity of genuine banknote and the denomination of each genuine banknote, the method for implementing banknote counting further comprises:

displaying the quantity of the genuine banknote and the amount of the genuine banknote.

6. The method for implementing banknote counting according to claim 1, wherein after the operation of extracting the counterfeit banknote from the banknotes that have been counted according to the sequence of the counterfeit banknote, and calculating the amount of the counterfeit banknote based on the quantity of the counterfeit banknote and the denomination of each counterfeit banknote, the method for implementing banknote counting further comprises:

displaying the quantity of the counterfeit banknote and the amount of the counterfeit banknote.

7. The method for implementing banknote counting according to claim 6, wherein after the operation of turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote, the method for implementing banknote counting further comprises:

recording the quantity of genuine banknote and the denomination of each genuine banknote, and calculating the amount of the genuine banknote based on the quantity of genuine banknote and the denomination of each genuine banknote.

8. The method for implementing banknote counting according to claim 7, wherein after the operation of recording the quantity of genuine banknote and the denomination of each genuine banknote, and calculating the amount of the genuine banknote based on the quantity of genuine banknote and the denomination of each genuine banknote, the method for implementing banknote counting further comprises:

displaying the quantity of the genuine banknote and the amount of the genuine banknote.

9. A banknote counting device, comprising:

a recording module, configured for turning on counterfeit distinguishing function if a banknote counting instruction carrying user identity information is received, and if counterfeit banknote is detected during the banknote counting process, recording the sequence of the counterfeit banknote, the denomination of each counterfeit banknote, and the quantity of the counterfeit banknote;

an extracting module, configured for extracting the counterfeit banknote from the banknotes that have been counted according to the sequence of the counterfeit banknote, and calculating the amount of the counterfeit banknote based on the quantity of the counterfeit banknote and the denomination of each counterfeit banknote;

a determining module, configured for acquiring the user identity information in the banknote counting instruction, and determining, according to the user identity information, whether a circulation amount and number of times of circulation of counterfeit currency having a mapping relationship to the user identity information exist in a preset counterfeit currency circulation database;

a calculating module, configured for, if the circulation amount and number of times of circulation of counterfeit currency having a mapping relationship to the user identity information exist in the preset counterfeit currency circulation database, calculating the sum of the circulation amount of counterfeit currency and the amount of the counterfeit banknote, and updating the circulation amount of counterfeit currency according to the sum; and adding "1" to the number of times of circulation of counterfeit currency and updating the number of times of circulation of counterfeit currency according to the calculation result; and an alarming module, configured for, if the updated circulation amount of counterfeit currency is greater than a preset amount threshold and the updated number of times of circulation of counterfeit currency is greater than a preset number of times of circulation threshold, sending an investigation instruction to the public security department according to the user identity information, the updated circulation amount of counterfeit currency, and the number of times of circulation of counterfeit currency, to allow the public security department implementing the investigation instruction in time.

10. The banknote counting device according to claim 9, further comprising:

an establishing module, configured for establishing a mapping relationship among the user identity information, the amount of the counterfeit banknote calculated, and the number of times of circulation of counterfeit currency in the counterfeit currency circulation database, if the circulation amount of counterfeit currency and the number of times of circulation of counterfeit currency having a mapping relationship to the user identity information does not exist in the counterfeit currency circulation database, where the number of times of circulation of counterfeit currency is recorded as "1".

11. The banknote counting device according to claim 10, further comprising:

a displaying module, configured for displaying the quantity of the counterfeit banknote and the amount of the counterfeit banknote.

12. The banknote counting device according to claim 11, wherein, the calculating module is further configured for recording the quantity of genuine banknote and the denomination of each genuine banknote, and calculating the amount of the genuine banknote based on the quantity of genuine banknote and the denomination of each genuine banknote.

13. The banknote counting device according to claim 12, wherein, the displaying module is further configured for displaying the quantity of the genuine banknote and the amount of the genuine banknote.

14. The banknote counting device according to claim 9, further comprising:

a displaying module, configured for displaying the quantity of the counterfeit banknote and the amount of the counterfeit banknote.

15. The banknote counting device according to claim 14, wherein, the calculating module is further configured for recording the quantity of genuine banknote and the denomination of each genuine banknote, and calculating the amount of the genuine banknote based on the quantity of genuine banknote and the denomination of each genuine banknote.

16. The banknote counting device according to claim 15, wherein, the displaying module is further configured for displaying the quantity of the genuine banknote and the amount of the genuine banknote.

* * * * *